US006854490B2

(12) United States Patent
Murray

(10) Patent No.: US 6,854,490 B2
(45) Date of Patent: Feb. 15, 2005

(54) FLEXIBLE POUCH WITH SELF-CONTAINED STRAW AND METHOD OF FORMING

(75) Inventor: R. Charles Murray, Sarasota, FL (US)

(73) Assignee: PPL Technologies, LLC, Sarasota, FL (US)

( * ) Notice: Subject to any disclaimer, the term of this patent is extended or adjusted under 35 U.S.C. 154(b) by 14 days.

(21) Appl. No.: 10/696,802

(22) Filed: Oct. 30, 2003

(65) Prior Publication Data

US 2004/0129337 A1 Jul. 8, 2004

Related U.S. Application Data

(60) Provisional application No. 60/422,281, filed on Oct. 30, 2002.

(51) Int. Cl.[7] ..... B65B 1/04

(52) U.S. Cl. ..... 141/10; 141/313; 141/114; 206/217; 229/103.1; 53/128.1; 53/410

(58) Field of Search ..... 53/128.1, 410; 141/10, 114, 313–319; 206/217, 218; 215/229; 220/705, 710; 229/103.1; 383/202, 906; 426/85

(56) References Cited

U.S. PATENT DOCUMENTS

| | | | | |
|---|---|---|---|---|
| 3,799,914 A | * | 3/1974 | Schmit et al. | 426/85 |
| 4,314,074 A | * | 2/1982 | Khoobiar | 562/535 |
| 4,614,074 A | * | 9/1986 | Evers | 53/236 |
| 5,782,344 A | | 7/1998 | Edwards et al. | 206/217 |
| 5,884,758 A | | 3/1999 | Sigouin et al. | 206/217 |
| 6,000,848 A | | 12/1999 | Massioui | 383/80 |
| 6,041,579 A | | 3/2000 | Savoury et al. | 53/551 |
| 6,293,073 B1 | * | 9/2001 | Caudle | 53/133.1 |
| 6,375,002 B2 | | 4/2002 | Edwards | 206/217 |
| 2003/0132233 A1 | | 7/2003 | Lee | 220/710 |
| 2003/0156766 A1 | | 8/2003 | Stefandl | 383/9 |

FOREIGN PATENT DOCUMENTS

| | | |
|---|---|---|
| WO | WO 98/38110 | 9/1998 |
| WO | WO 99/02423 | 1/1999 |

* cited by examiner

*Primary Examiner*—Steven O. Douglas
(74) *Attorney, Agent, or Firm*—Gifford, Krass, Groh, Sprinkle, Anderson & Citkowski, P.C.

(57) ABSTRACT

A flexible pouch with a self-contained straw for packaging a product includes a front panel and a back panel each having an upper edge, a lower edge opposite the upper edge, and side edges extending therebetween the upper and lower edges. A straw is disposed inside the pouch at an angle between an upper corner of the pouch and an opposite lower corner. The pouch includes a first seal applied to the upper corner of the pouch to form a pocket for holding an upper end of the straw, and a second seal extending along the unsealed portion of the upper edge of the pouch to close the pouch. A method of forming and filling a flexible pouch with an integral straw includes the steps of forming each of the panels and joining two panels by sealing together their side edges and lower edge to form the pouch. The method also includes the steps of opening the pouch and inserting the straw into the pouch by positioning the straw at an angle between an upper corner of the pouch and an opposite lower corner. The method further includes the steps of applying a first seal to the upper corner of the pouch to form a pocket for holding an upper end of the straw, and filling the pouch with the product. The method also includes the steps of applying a second seal extending along the unsealed portion of the upper edge of the pouch to close the pouch.

12 Claims, 3 Drawing Sheets

FLEXIBLE POUCH WITH SELF-CONTAINED STRAW AND METHOD OF FORMING

RELATED APPLICATION

This application claims priority of U.S. Provisional Patent Application Ser. No. 60/422,281 filed Oct. 30, 2002, which is incorporated herein by reference.

BACKGROUND OF THE INVENTION

1. Field of the Invention

The present invention relates generally to flexible pouches for packaging a product and, more specifically, to a flexible pouch with a self-contained straw for packaging a product, and a method of manufacturing the same.

2. Description of the Related Art

Various types of disposable, portable containers are known in the art for storing a fluid or dry product, such as a liquid, granular material, powder or the like. One example of such a container is a flexible pouch. Consumers prefer the convenience of flexible pouches, due to their shape and size and improved shelf life. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

The flexible pouch is made from a flexible material, preferably a laminate composed of sheets of plastic or aluminum or the like. In this example, the material is available in sheet form, on a roll. An outer layer of the material may include preprinted information, such as a logo or the like, to provide the consumer with information regarding the contents of the pouch. The pouch may be formed using conventionally known manufacturing techniques, such as a horizontal form-fill seal machine, a flat bed pre-made pouch machine, a vertical form fill machine, or the like. The pouch is generally formed by folding sheets of material over each other to achieve a predetermined shape. Edges, such as a side edge, are joined together using a sealing technique such as bonding or welding. Alternatively, the pouch is formed by laying one layer of material over a second layer of material and forming a gusset along two parallel edges to form a pouch capable of standing unsupported. An upper edge of the front panel and back panel is generally not sealed until after the pouch is filled. The empty pouch may be placed in a holder such as a cup or puck prior to the filling process. To fill the pouch, the upper edges of the pouch are spread apart. For example, a concentrated flow of gas is directed towards the upper edge of the pouch to separate the panels. Grippers may also be utilized at the same time to pull the panels apart. The pouch is filled, sealed and finished.

Fluid filled pouches frequently include a straw for removing the product from the pouch. In the past, the straw was temporarily attached to the outside of the pouch, such as by gluing or the like. However, straws sometimes fall off the pouch and get lost in handling of the pouch. There have been several attempts to place a straw inside the pouch. One problem associated with providing a straw inside the pouch is movement of the straw during the filling step. Another problem is access to the straw. Thus, there is a need in the art for a flexible pouch with a self-contained straw that can be reliably positioned prior to filling, and a method of making a pouch with a self-contained straw.

SUMMARY OF THE INVENTION

Accordingly, the present invention is a flexible pouch with a self-contained straw and an improved method for manufacturing and filling the pouch. The flexible pouch with straw includes a front panel and a back panel each having an upper edge, a lower edge opposite said upper edge, and side edges extending therebetween the upper and lower edges. The straw is disposed inside the pouch at an angle between an upper corner of the pouch and an opposite lower corner. The pouch includes a first seal applied to the upper corner of the pouch to form a pocket for holding an upper end of the straw, and a second seal extending along the unsealed portion of the upper edge of the pouch to close the pouch.

A method of forming and filling a flexible pouch with a self-contained straw includes the steps of forming each of the panels and joining the two panels by sealing together their side edges and lower edge to form the pouch. The method also includes the steps of opening the pouch and inserting the straw into the pouch by positioning the straw at an angle between an upper corner of the pouch and an opposite lower corner. The method further includes the steps of applying a first seal to the upper corner of the pouch to form a pocket for holding an upper end of the straw and filling the pouch with the product. The method also includes the steps of applying a second seal extending along the unsealed portion of the upper edge of the pouch. The pouch may be finished to achieve a desired shape.

One advantage of the present invention is that a method of making a flexible pouch having a self-contained straw is provided. Another advantage of the present invention is that an upper edge of the pouch includes a sealed section, which forms a pocket for holding the straw in the pouch while the pouch is being filled. Still another advantage of the present invention is that the flexible pouch is more cost-effective to manufacture, since the straw is positively inserted and located in the pouch. A further advantage of the present invention is that the pouch is easy for the user to open and access the straw.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Referring to FIGS. 3–6, a flexible pouch 10 with self-contained straw is illustrated. Flexible pouches are utilized to contain various products, including fluids such as juice, dry products such as chips, dog food, shredded cheese, or the like, or personal care items such as soaps or lotions, or sterile medical items. In this example, the product is a fluid, such as juice, which is removed from the pouch using a straw. The pouch may contain a single serving of a product, or multiple servings. It is contemplated that the pouch illustrated in FIGS. 4–6 contains a tear-off portion formed at the top for accessing the straw and product contained therein.

Figure 3:
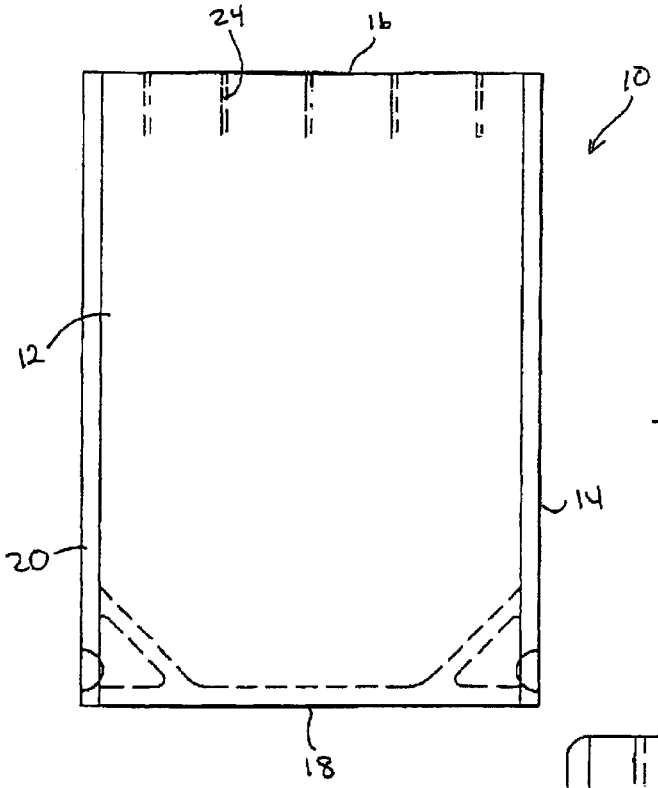
FIG. 3 is an elevational view of an unfilled pouch, according to the present invention.

As shown in FIG. 3, the unfilled pouch 10 includes a front panel 12 and a back panel 14 that are joined together in a manner to be described to form a pouch 10. In this example, each panel 10 has a generally rectangular shape, although other shapes are contemplated. Further, the panel is defined by an upper edge 16, an opposed lower edge 18, and side edges 20 extending therebetween the upper and lower edges 16, 18. The pouch 10 may include a sidewall 22 disposed between the side edges and lower edge, which allows the pouch 10 to stand upright. For example, the sidewall may form a gusset which is generally wider at the lower edge, and tapers upwardly towards the upper edge.

The flexible pouch 10 may advantageously include a guide pocket 24 formed in a panel 12, 14 or wall of the pouch 10 prior to filling and sealing, to facilitate the separation of the front and back panels 12, 14 prior to the filling of the pouch 10. An example of such a pouch is disclosed in commonly assigned U.S. patent application Ser. No. 10/310,221.

The flexible pouch 10 is formed of laminate sheets. In one embodiment, the laminate includes at least one layer of virgin polyethylene terphalate (PET) and at least one layer of aluminum foil or EVOM.

The pouch also includes a straw 26 positioned in the pouch 10 at an angle. The upper end 260 of the straw is held in place by a pocket 28 formed in an upper corner 30 of the pouch, in a manner to be described. Advantageously, the straw 26 is rigidly supported within the pouch 10 so that it does not move freely within the pouch 10.

It should be appreciated that the pouch 10 may include other components or features, as is known in the art. For example, an upper edge 16 of the panel 12, 14 may include a weakened area, to facilitate opening the pouch 10 by tearing off an upper portion of the top, as shown at 36.

Figure 1:
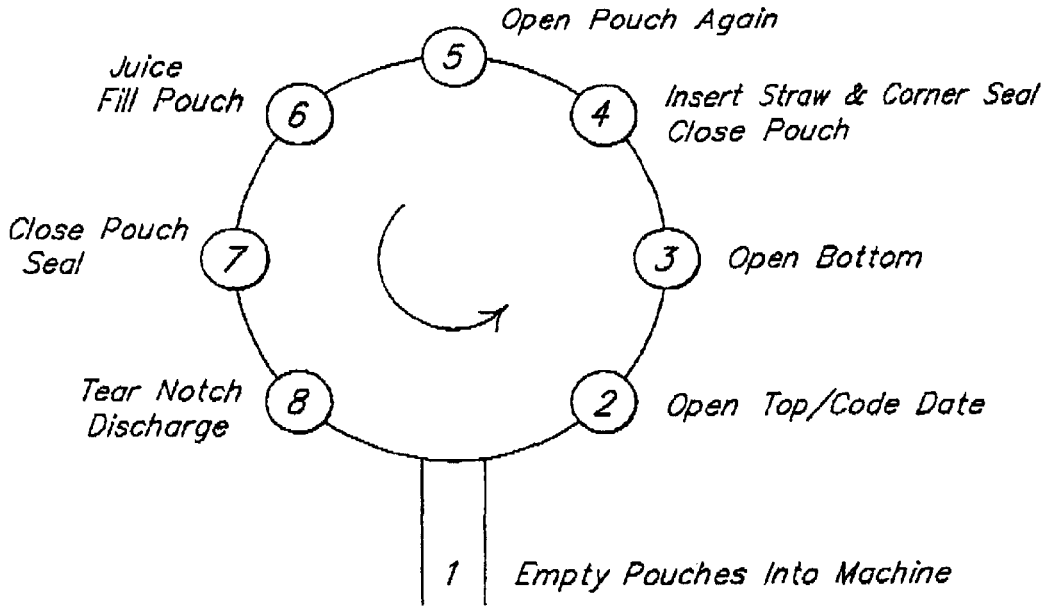
FIG. 1 is a diagram of an apparatus for forming a flexible pouch with a self-contained straw, according to the present invention.
Figure 2:
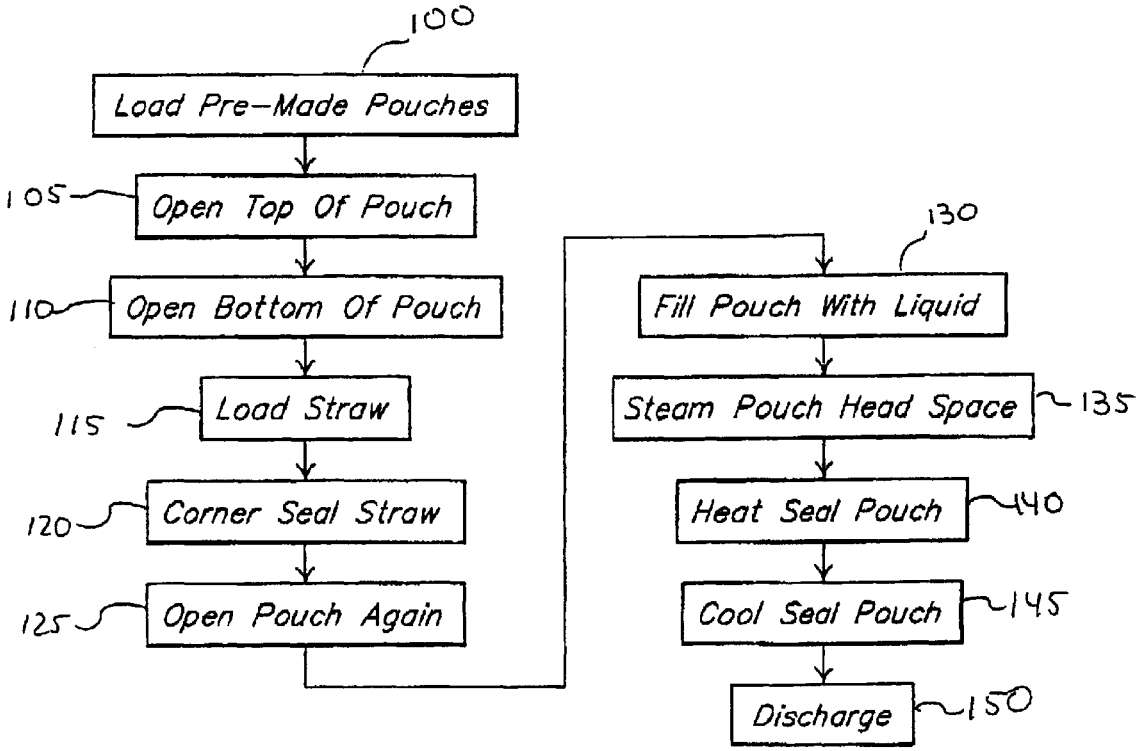
FIG. 2 is a flowchart of a method of forming and filling a flexible pouch with a self-contained straw, according to the present invention.

Referring to FIG. 1, an apparatus for forming and filling a flexible pouch 10 having a self-contained straw 26, using the method described with respect to FIG. 2, is illustrated. The method begins in block 100 with the step of loading the unfilled, preformed pouch 10 into the filling apparatus at station 1.

It is contemplated that the pouch 10 is formed from panels 12, 14 that define the walls of the pouch 10 in a panel cutting operation. A preprinted laminate material is utilized, such as a sheet of flexible material, such as polypropylene, aluminum or the like. The material is removed from the roll and cut into panels 12, 14. Each panel 12, 14 has a predetermined shape, which in this example is a rectangle. The material is cut into a panel 12, 14 using a known cutting apparatus, such as a laser or punch or the like.

Alternatively, the pouches 10 may be provided in a bandolier. In this type of apparatus, a strip of pouches 10 arranged bottom to top is provided. The pouches 10 are sealed across the lower edge 18, so that they are sterile until a cut is made through them separating the two pouches 10 from one another and providing an opening at the top of one of the pouches 10. The lower edge 18 of the adjacent pouch is trimmed to shape, for example the corners may be angled. The cut may be performed using a cutter or a die cut or the like.

A crease or guide pocket 24 may be formed in a top portion of each panel 14 in a creasing operation to facilitate opening of the pouch prior to the filling of the pouch. An example of a method of forming a crease in a panel to facilitate opening the pouch is disclosed in commonly assigned U.S. patent application Ser. No. 10/310,221, and is incorporated herein by reference.

The lower and side edges 18, 20 of the pouch 10 are joined together in a sealing operation. In this example, the edges 18, 20 are joined together using a conventionally known sealing process, such as the application of heat and compression. Another example of a two-step sealing process involving a slow, low temperature seal and a fast higher temperature seal is disclosed in U.S. Patent Application No. 60/422,282, which is incorporated herein by reference.

In this example, the pouch 10 is placed onto a carrier for transporting the pouch. The carrier includes a plurality of holders (not shown) which support the pouch. An example of a holder is a cup-shaped member, as disclosed in commonly assigned U.S. patent application Ser. No. 10/336,601, which is incorporated herein by reference. Alternatively, the pouch 10 may be held with grippers (not shown) as is known in the art. The methodology advances to block 105.

In block 105, the pouch 10 is opened in an opening operation, as shown at station 2. Various techniques are conventionally known in the art for opening the pouch 10. For example, the guide pocket 24 formed in the front panel 12 and back panel 14 facilitates opening the upper edges of the pouch. A nozzle (not shown) may be mechanically lowered into the guide pocket 12 to direct a stream of compressed gas into the guide pocket 24, to force the walls of the pouch 10 away from each other. An example of a gas is carbon dioxide or nitrogen. It should be appreciated that a date code may also be stamped in a panel at this station. The methodology advances to block 110.

In block 110, the rest of the pouch 10 is fully opened, as shown at station 3. For example, the opening station may include a manifold (not shown), with a hood extending over the top of the edges of the pouch. The manifold has rows of apertures formed above the upper edges 16 of the panels 12, 14 of the pouch 10. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the panels 12, 14 and assist in separation of the panels 14. A diving rod, as is known in the art, may then be used to make sure the pouch 10 is fully opened. The methodology advances to block 115.

In block 115, a straw 26 is inserted into the pouch 10 in a predetermined position at a straw insertion and corner seal station 4. In this example, the straw 26 is inserted at an angle into the opened pouch, as shown on FIG. 4. Preferably, the straw 26 is inserted by lowering a tube having a straw inside into the open end of the pouch at an angle. The straw is blown out of the tube and into the pouch 10 using pressurized air. An upper end of the straw 26 is located at an upper corner 30 of the pouch 10, and a lower end of the straw 26 is located at an opposite lower corner 32 of the pouch 10. The methodology advances to block 120.

Figure 4:
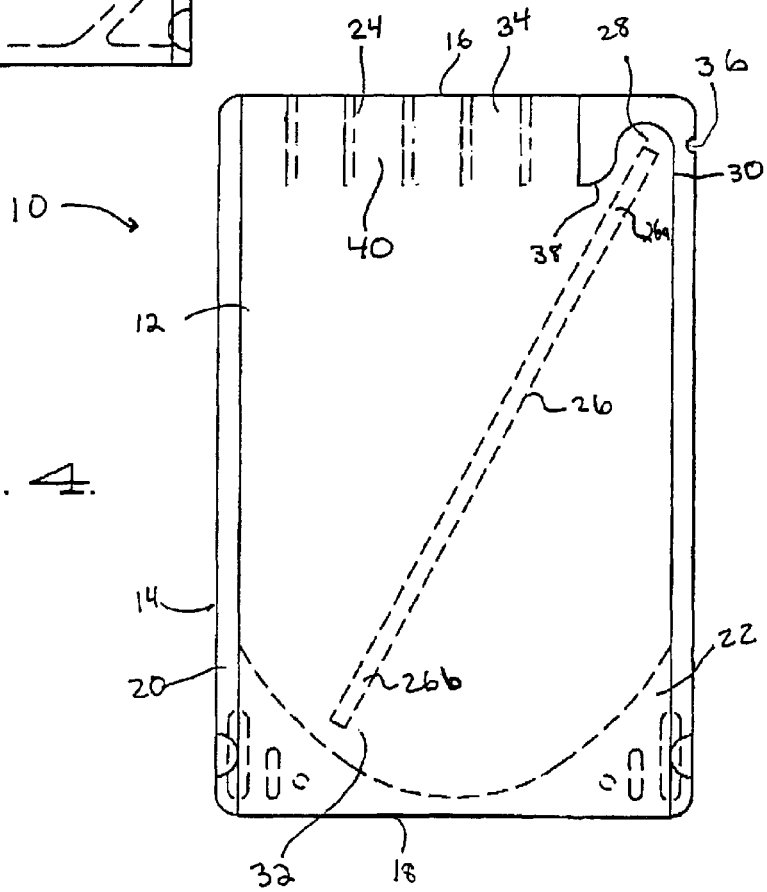
FIG. 4 is an elevational view of a pouch with the straw inserted, according to the present invention.
Figure 5:
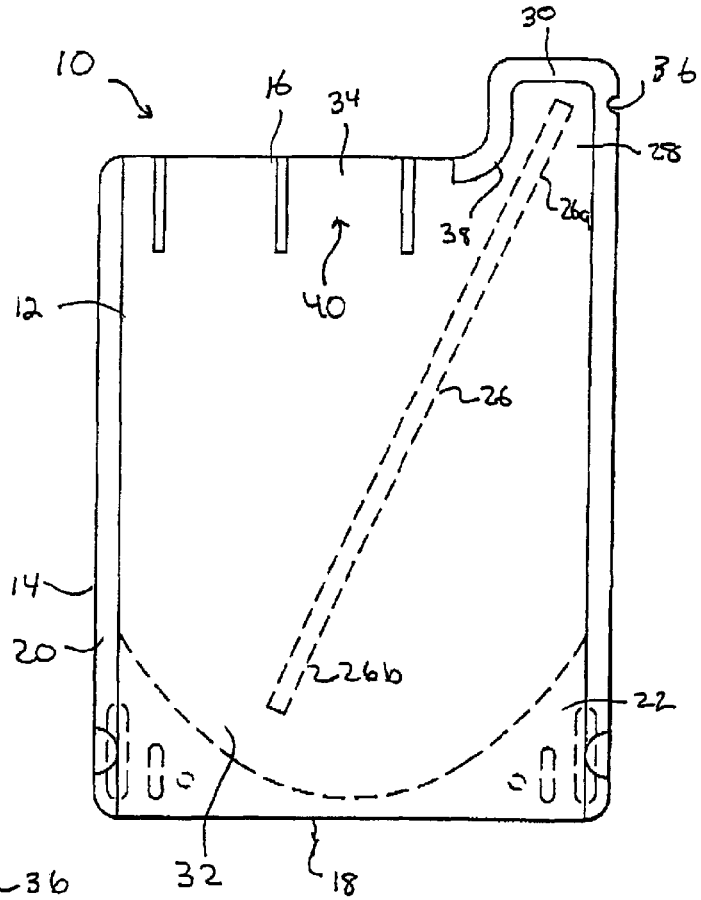
FIG. 5 is an elevational view of a filled pouch, according to the present invention.

In block 120, a pocket 28 is formed in the pouch 10 containing the upper end 26*a* of the straw 26, as shown in FIG. 4. The pocket 28 is formed around the upper corner 30 of the pouch containing an end of the straw by applying a first seal 38. The first seal 38 preferably is an ultrasonic seal involving the application of heat and pressure. The methodology advances to block 125.

In block 125, the unsealed portion 34 of the pouch adjacent the pocket is reopened at an opening station 5 using the guide pocket 24 formed in the front panel 12 and back panel 14 in another opening operation, as previously described. The methodology advances to block 130.

In block 130, the reopened pouch 10 is filled with the product at a filling station 6. For example, a fill tube (not shown) is lowered into the opened, unsealed portion 34 of the pouch 10 adjacent the pocket 28, and the product is dispensed into the open pouch 10. The methodology advances to block 135.

In block 135, the contents of the pouch 10 are treated prior to sealing, such as by the application of steam to reduce the headspace. Headspace is the unfilled portion of the pouch between the product and the sealed upper edge. The methodology advances to block 140.

In block 140, a second seal 40 is applied to the unsealed portion 38 of the upper edges 16 of the pouch 10 using a conventionally known sealing technique as previously described at a sealing station 7. For example, the unsealed portion 34 of the upper edges 16 is sealed together, such as by using a combination of heat and pressure. Another example of a sealing technique is an ultrasonic sealing process. It should be appreciated that the sealing process removes any guide pocket 24, if present, from the panels 12, 14.

Figure 6:
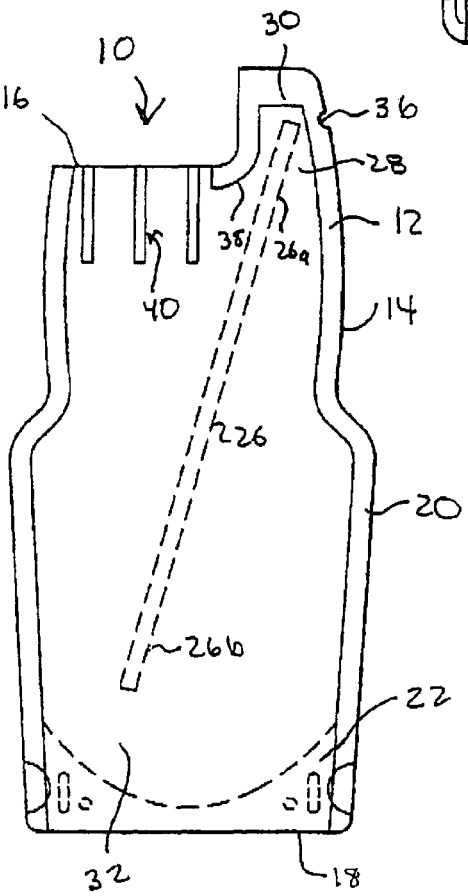
FIG. 6 is an elevational view of a finished pouch, according to the present invention.

The methodology advances to block 145, and the pouch 10 is finished at a finishing station 8. For example, the sealed pouch 10 is cooled. In addition, a tear notch 36 may be formed in the pocket portion 28 of the pouch 10 to facilitate opening the pouch 10 and accessing the straw 26 to remove the product from the pouch 10. In another finishing operation, the edges of the pouch 10 are trimmed to achieve a desired shape, as shown in FIG. 6. The methodology advances to block 150 and the finished pouch is discharged from the machine.

It should be appreciated that the methodology may include other steps, such as an upstream oxygen purging station, a downstream oxygen purging station, or the like. In addition, a manufacturing station may perform one or a plurality of operations, to enhance the efficiency of the methodology.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A flexible pouch with a self-contained straw comprising:

a front panel and a back panel each having an upper edge, a lower edge opposite said upper edge, and side edges extending therebetween said upper and lower edges, wherein said front panel and said bacic panel are initially joined together at said side edges and said lower edge to form the pouch;

a straw fixedly disposed inside the pouch, wherein said straw is positioned at an angle between an upper corner of the pouch and an opposite lower corner;

a first seal applied to said upper corner of the pouch to form a pocket for holding an upper end of said straw; and a second seal extending along said upper edge of the pouch to close the pouch.

2. A flexible pouch with a self-contained straw comprising:

a front panel and a back panel each having an upper edge, a lower edge opposite said upper edge, and side edges extending therebetween said upper and lower edges, wherein said front panel and said back panel are initially joined together at said side edges and said lower edge to form the pouch;

a straw disposed inside the pouch, wherein said straw is positioned at an angle between an upper corner of the pouch and an opposite lower corner;

a first seal applied to said upper corner of the pouch to form a pocket for holding an upper end of said straw, wherein said first seal has a generally inverted "U" shape; and a second seal extending along said upper edge of the pouch to close the pouch.

3. A flexible pouch as set forth in claim 2, wherein the panel is formed from a laminate material.

4. A method of forming and filling a flexible pouch with a self-contained straw, said method comprising the steps of:

forming a panel having an upper edge, a lower edge opposite the upper edge, and side edges extending therebetween the upper and lower edge;

joining two panels by sealing together their side edges and lower edge to form the pouch;

opening the pouch;

inserting the straw into the pouch, wherein the straw is positioned at an angle between an upper corner of the pouch and an opposite lower corner;

applying a first seal to the upper corner of the pouch to form a pocket for holding an upper end of the straw;

filling the pouch with the product; and applying a second seal extending along the unsealed portion of the upper edge of the pouch to close the pouch.

5. A method as set forth in claim 4 wherein said first seal has a generally inverted "U" shape.

6. A method as set forth in claim 4, wherein the panel is formed from a laminate material.

7. A method as set forth in claim 4 wherein said step of joining the lower and side edges of the pouch together includes the step of sealing the edges using a combination of heat and pressure.

8. A method as set forth in claim 4 wherein said step of separating the panels further includes the step of directing a stream of compressed gas into the pouch to forcibly separate the walls of the pouch.

9. A method as set forth in claim 4 further including the step of finishing the pouch by trimming the upper edge, side edges and lower edge of the pouch to a predetermined shape.

10. A method as set forth in claim 4 wherein said step of applying a second seal further includes the step of sealing the unsealed portion of the upper edges of the panels together using a combination of heat and pressure, to seal the pouch.

11. A method of forming and filling a flexible pouch with a self-contained straw, said method comprising the steps of:

forming a panel from a laminate material having an upper edge, a lower edge opposite the upper edge, and side edges extending therebetween the upper and lower edge;

joining two panels by sealing together their side edges and lower edge using a combination of heat and pressure to form the pouch;

opening the pouch;

inserting the straw into the pouch, wherein the straw is positioned at an angle between an upper corner of the pouch and an opposite lower corner;

applying a first seal to the upper corner of the pouch to form a pocket for holding an upper end of the straw, wherein the first seal has a generally inverted "U" shape;

filling the pouch with the product;

applying a second seal extending along the unsealed portion of the upper edge of the pouch to close the pouch; and finishing the pouch by trimming the upper edge, side edges and lower edge of the pouch to a predetermined shape.

12. A method as set forth in claim 11 wherein said step of separating the panels further includes the stop of directing a stream of compressed gas into the pouch to forcibly separate the wells of the pouch.

* * * * *

UNITED STATES PATENT AND TRADEMARK OFFICE

CERTIFICATE OF CORRECTION

PATENT NO. : 6,854,490 B2
DATED : February 15, 2005
INVENTOR(S) : R. Charles Murray It is certified that error appears in the above-identified patent and that said Letters Patent is hereby corrected as shown below:

Column 5,
Line 65, "bacic" should be replaced with -- back --.

Signed and Sealed this

Nineteenth Day of July, 2005

JON W. DUDAS
*Director of the United States Patent and Trademark Office*